US005897243A

United States Patent [19]

Komatsubara et al.

[11] Patent Number: 5,897,243

[45] Date of Patent: Apr. 27, 1999

[54] ELECTROPHOTOGRAPHIC RECORDING APPARATUS CONFIGURED TO SWITCH A BIAS VOLTAGE IN A DEVELOPING UNIT

[75] Inventors: Satoru Komatsubara, Isehara; Kazuhiro Yuasa, Zama; Eiji Takenaka, Atsugi; Mugijiroh Uno, Isehara; Toshihiro Sugiyama; Tetsuo Yamanaka, both of Tokyo; Eisaku Murakami, Hiratsuka, all of Japan

[73] Assignee: Ricoh Company, Ltd., Tokyo, Japan

[21] Appl. No.: 08/638,696

[22] Filed: Apr. 26, 1996

[30] Foreign Application Priority Data

Apr. 28, 1995 [JP] Japan ..... 7-106537
Apr. 19, 1996 [JP] Japan ..... 8-098819

[51] Int. Cl.[6] ..... G03G 15/08

[52] U.S. Cl. ..... 399/98; 399/66; 399/234; 399/235

[58] Field of Search ..... 399/55, 66, 234, 399/235, 98, 101

[56] References Cited

U.S. PATENT DOCUMENTS 5,253,022 10/1993 Takeuchi et al. ..... 399/313
5,486,909 1/1996 Takenaka et al. ..... 399/274
5,489,747 2/1996 Takenaka et al. ..... 399/272

FOREIGN PATENT DOCUMENTS 43 42 060 6/1994 Germany .
62-194272 8/1987 Japan .
6-175477 6/1994 Japan .
7-92804 4/1995 Japan .

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

In an electrophotographic image recording apparatus of the type using a single-ingredient type developer, i.e., toner, a latent image is electrostatically formed on a photoconductive drum or similar image carrier. A developing unit has a developing roller for conveying the toner deposited thereon, and an intermediate roller for conveying the toner transferred thereto from the developing roller and depositing it on the latent image to thereby produce a corresponding toner image. An image transfer unit transfers the toner image to a cut sheet. During the development of an area of the image carrier other than a latent image area, at least one of biases assigned to the developing roller and intermediate roller, respectively, is switched over to thereby form an electric field different in direction from an electric field assigned to the formation of the toner image between the two rollers. As a result, the toner existing on the intermediate roller is collected by the developing roller. This successfully prevents the toner from depositing on the intermediate roller except when required, and frees the image transfer unit from the deposition of the toner.

18 Claims, 9 Drawing Sheets

ELECTROPHOTOGRAPHIC RECORDING APPARATUS CONFIGURED TO SWITCH A BIAS VOLTAGE IN A DEVELOPING UNIT

BACKGROUND OF THE INVENTION

The present invention relates to a plain paper copier, plain paper facsimile apparatus, printer or similar electrophotographic recording apparatus.

An electrophotographic recording apparatus includes a developing unit having a construction taught in, e.g., Japanese Patent Laid-Open Publication No. 6-175477. The developing unit has a casing storing a single-ingredient type developer, i.e., toner having high electric resistance. First toner conveying means in the form of a roller is disposed in the casing and receives the toner from a toner supply roller. The toner is magnetically deposited on the conveying means. Second toner conveying means implemented as an elastic roller intervenes between the first toner conveying means and a photoconductive drum or image carrier. The toner is electrically transferred from the first conveying means to the second conveying means. Toner particles charged to the polarity opposite to the expected or regular polarity are prevented from being transferred from the first conveying means to the second conveying means. This allows the second conveying means to deposit only the toner of regular polarity on a latent image electrostatically formed on the drum.

While the development of the latent image is not under way, the absence of the toner on the second conveying means does not matter at all in respect of the image forming process. However, if the toner is present on the second conveying means or similar member contacting the drum, then it is likely to easily deposit on the drum, compared to the case wherein it is absent. As a result, not only the toner is wastefully consumed, but also the resulting image has its background contaminated.

Further, assume that image transferring means for transferring the toner image from the drum to a sheet is of the type contacting the drum. Then, if the charge of the toner existing on the drum is unstable, it is likely that the toner is transferred from the drum to the image transferring means. This part of the toner smears the rear of a sheet.

SUMMARY OF THE INVENTION

It is therefore an object of the present invention to provide an electrophotographic recording apparatus capable of preventing toner from depositing on second toner conveying means except when required, and obviating the deposition of toner on image transferring means.

An electrophotographic recording apparatus of the present invention includes an image carrier for electrostatically forming a latent image thereon. A developing unit has a first toner conveying member for conveying a single-component type toner deposited thereon, and a second toner conveying member for conveying the toner transferred thereto from the first toner conveying member and depositing the toner on the latent image to thereby produce a corresponding toner image. An image transfer unit transfers the toner image to a sheet. A controller switches, during development (i.e., which includes deposition of toner to an image carrier) in an area of the image carrier other than a latent image area, at least one of a bias assigned to the first toner conveying member and a bias assigned to the second toner conveying member to thereby form an electric field different in direction from an electric field assigned to the formation of the toner image between the first and second toner conveying members. As a result, the toner existing on the second toner conveying member is collected by the first toner conveying member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
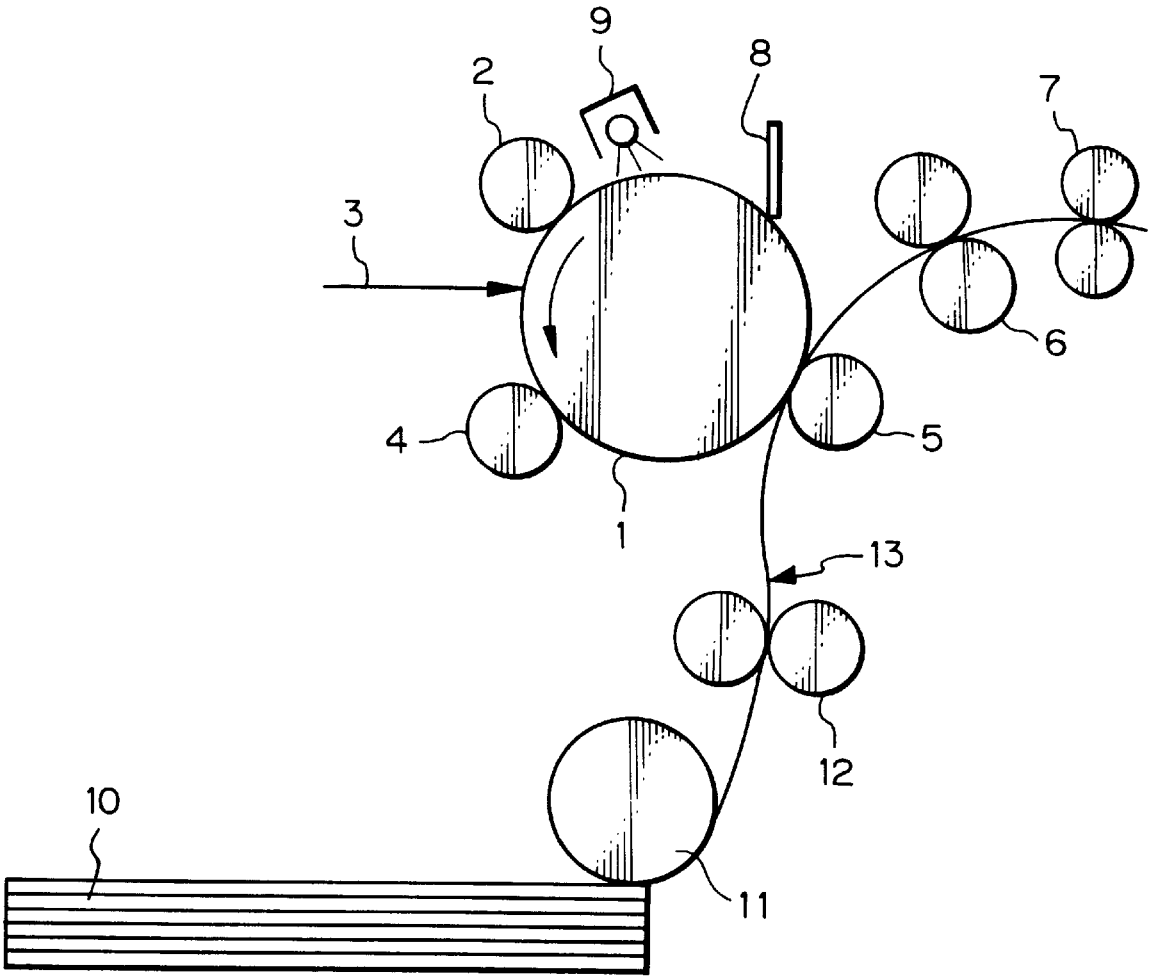
FIG. 1 shows the basic construction of an electrophotographic recording apparatus in accordance with the present invention.

Referring to FIG. 1 of the drawings, the basic construction of an electrophotographic recording apparatus in accordance with the present invention is shown. As shown, the apparatus has a photoconductive element, or image carrier, implemented as a drum 1. A charger 2 uniformly charges the surface of the drum 1. An optical writing device represented by an arrow 3 exposes the charged surface of the drum 1 imagewise in order to electrostatically form a latent image thereon. A developing unit 4 selectively deposits a single-ingredient type developer, or toner, on the drum 1 to thereby transform the latent image to a toner image. An image transfer unit 5 is implemented as a roller and transfers the toner image from the drum 1 to a cut sheet 10. A fixing unit 6 fixes the toner image on the sheet 10 by heating it. A discharge roller 7 drives the sheet 10 carrying the fixed toner image out of the apparatus. A cleaning unit 8 removes the toner remaining on the drum 1 after the image transfer. A discharger 9 dissipates the charge also remaining on the drum 1 after the image transfer. The sheet 10 is fed by a pick-up roller 11 to a registration roller 12. The registration roller 12 once stops the sheet 10 and then drives it toward the image transfer unit 5 at a preselected timing. A sheet position sensor 13 is located downstream of the registration roller 12 with respect to the direction in which the sheet 10 is conveyed toward the image transfer unit 5. The sensor 13 is responsive to the leading edge or the trailing edge of the sheet 10.

Figure 2:
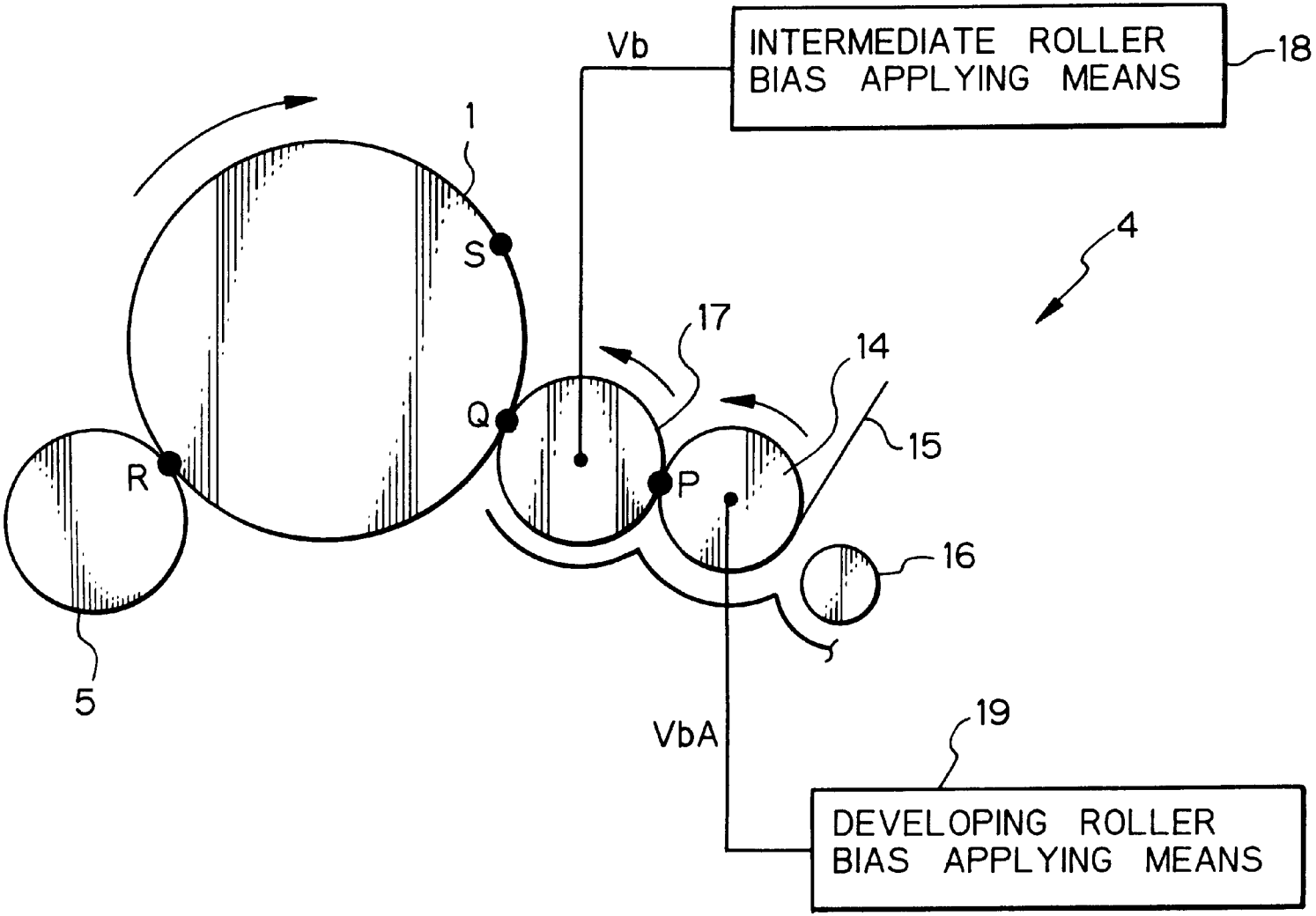
FIG. 2 shows the basic construction of a developing unit included in the construction of FIG. 1.

FIG. 2 shows the basic configuration of the developing unit 4. As shown, the developing unit 4 has a developing roller or first toner conveying means 14. The roller 14 is a hard roller magnetized at a preselected pitch. A resilient doctor blade 15 is formed of metal and pressed against the roller 14 under a predetermined pressure in order to regulate the amount of toner to deposit on the roller 14. A toner supply roller 16 supplies the toner to the developing roller 14 while agitating it. An intermediate roller or second toner conveying means 17 is held in contact with each of the developing roller 14 and drum 1 over a predetermined range. The intermediate roller 17 is a soft roller formed of conductive rubber or similar material. Intermediate roller bias applying means 18 applies a bias Vb to the intermediate roller 17. Likewise, developing roller bias applying means 19 applies a bias VbA to the developing roller 14.

In FIG. 2, the optical writing device 3 writes an image on the drum 1 at a position S. The developing roller 14 and intermediate roller 17 contact each other at a position P. The intermediate roller 17 and drum 1 contact each other at a position or nip Q. The image transfer unit or roller 5 and drum 1 contact each other at an image transfer position R.

An electrophotographic process to be executed by the above apparatus will be described with reference to FIG. 1. The drum 1 is rotated counterclockwise, as indicated by an arrow. The charger 2 uniformly charges the surface of the drum 1. While the charged surface of the drum 1 is in movement, the optical writing device 3 exposes it imagewise to thereby electrostatically form a latent image. The developing unit 4 selectively transfers the toner to the latent image formed on the drum 1 so as to produce a corresponding toner image. When the sheet 10 is brought to the image transfer roller 5 via the pick-up roller 11 and registration roller 12, the roller 5 transfers the toner image from the drum 1 to the sheet 10. The sheet 10 with the toner image has the image fixed by the fixing unit 6 and then driven out of the apparatus by the discharge roller 7 as a hard copy. The toner left on the drum 1 after the image transfer is removed by the cleaning unit 8 while the charge left on the drum 1 is dissipated or discharged by the discharger 9. As a result, the surface potential of the drum 1 is restored to 0 V. The above procedure will be repeated when a plurality of hard copies are desired.

Referring again to FIG. 2, the development included in the electrophotographic process will be described specifically. During development, the developing roller 14 and intermediate roller 17 are each rotated counterclockwise, as indicated by an arrow. The drum 1 is rotated clockwise, as also indicated by an arrow. First, the toner supply roller 16 in rotation conveys the toner to beneath the developing roller 14. Because the toner is a single-ingredient type magnetic toner, it is deposited on the surface of the magnetized developing roller 14. The roller 14 conveys the toner toward the intermediate roller 17. At this instant, the doctor blade 15 regulates the toner on the roller 14 to form a thin toner layer while charging it by friction. Assume that the expected or regular polarity of the charge to deposit on the toner is negative by way of example.

The writing unit 3 exposes the surface of the drum 1 having been uniformly charged to about −750 V by the charger 2. As a result, the surface potential of the drum 1 varies to about −100 V in the exposed portion; that is, a potential distribution which is about −100 V in the exposed portion and about −750 V in the unexposed portion or background is set up on the drum 1. The bias Vb applied to the intermediate roller 17 and the bias VbA applied to the developing roller 14 are about −400 V and about −700 V, respectively.

The toner is charged to the negative polarity, and the surface potential of the intermediate roller 17 is higher than that of the developing roller 14, as stated above. As a result, the toner deposited on the roller 14 is transferred to the roller 17 at the position P, forming a toner layer on the roller 17. Although toner particles of positive or irregular polarity may exist on the roller 14, they are not transferred to the roller 17 because the surface potential of the roller 17 is higher than that of the roller 14.

The unexposed or background area of the drum 1 is lower in surface potential than the intermediate roller 17 while the exposed or image area of the drum 1 is higher in surface potential than the roller 17. In this condition, the toner on the roller 17 is transferred only to the latent image on the drum 1, thereby transforming the latent image to a corresponding toner image.

The toner image is transferred from the drum 1 to the sheet 10 and then fixed on the sheet 10, as stated earlier.

Figure 3A:
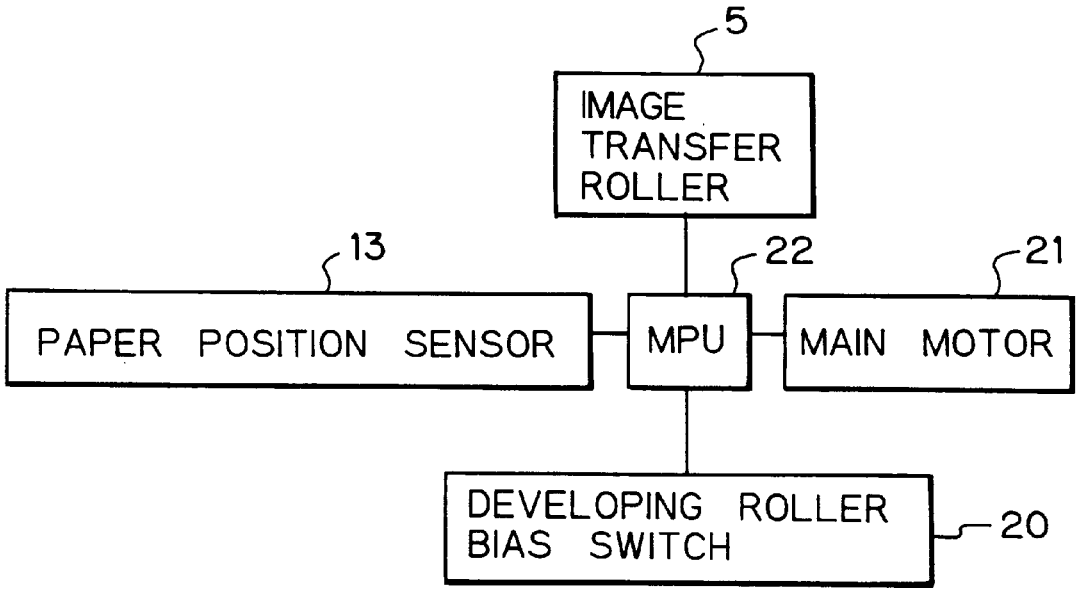
FIGS. 3A and 3B each shows an essential part of a control system included in the apparatus of FIG. 1.
Figure 3B:
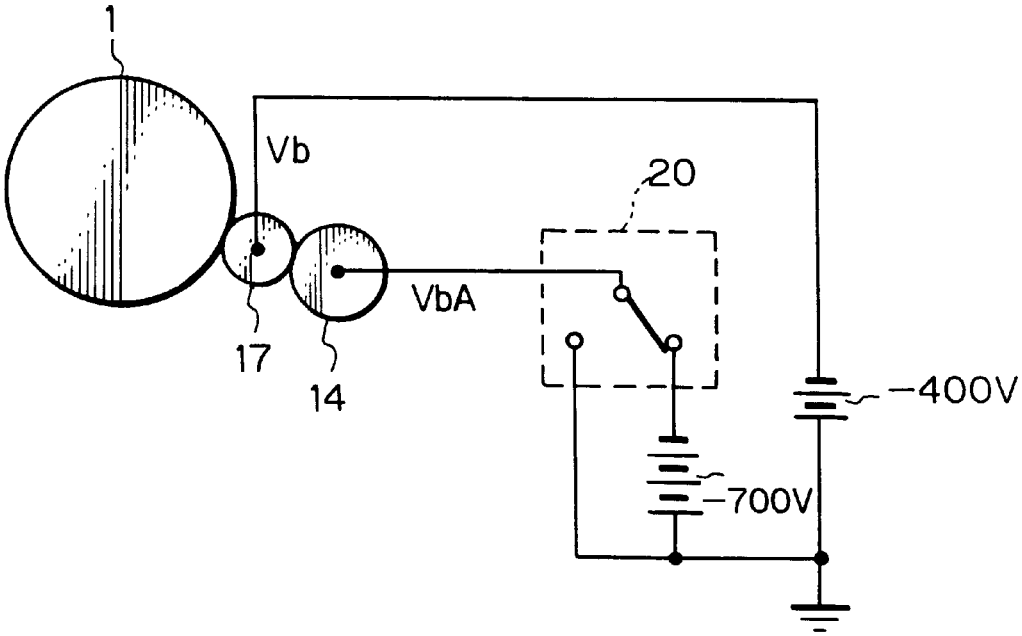

FIGS. 3A and 3B show an essential part of a control system included in the above recording apparatus. As shown, a switch 20 selectively switches the bias VbA assigned to the developing roller 14 to −700 V or 0 V (ground; GND). A main motor 21 is a drive source for driving the drum 1. An MPU (Micro Processor Unit) 22 controls the switch 20 in response to the output of the sheet position sensor 13, FIG. 1. The bias Vb assigned to the intermediate roller 17 is selected to be −400 V.

How the biases applied to the rollers are switched will be described with reference to FIG. 4. As shown, just before the main motor 21 is energized, the bias of −400 V and the bias of −700 V are applied to the intermediate roller 17 and developing roller 14, respectively. After the sheet 10 has begun to be picked up, the writing device starts writing a latent image on the drum 1. At the position P, FIG. 2, where the rollers 14 and 17 contact, the toner is fed to the latent image in order to transform it to a toner image. On the elapse of a period of time A as counted from the time when the latent image has been formed at the position S, FIG. 2, the toner image arrives at the image transfer position R.

Assuming that the arc SR has a length p, and that the drum 1 moves at a linear velocity v, then the above period of time A is expressed as $A=p/v$. Specifically, on the elapse of the period of time A, a bias is applied to the image transfer unit 5 so as to transfer the toner image from the drum 1 to the sheet 10 passing through the position R.

After the above latent image area of the drum 1 has been fully developed, the next latent image area of the drum 1 begins to be developed in a predetermined period of time. During the interval between the consecutive developments, the switch 20 switches the bias VbA assigned to the developing roller 14 from −700 V to GND only for a preselected period of time B. The period of time B should preferably be as long as possible, i.e., equal to the maximum period of time necessary for the interval between the consecutive sheets 10 to move away from the position or nip Q.

By the above control, during the development of the area other than the latent image areas, the surface potential of the intermediate roller 17 is maintained lower than that of the developing roller 14. This prevents the toner from being transferred from the roller 14 to the roller 17 while causing the toner to be electrostatically returned from the roller 17 to the roller 14. In addition, because the rollers 14 and 17 move in opposite directions to each other, as seen at the point P, the toner on the roller 17 is removed by a mechanical force and transferred to the roller 14. In this manner, the toner is collected from the roller 17 by the roller 14.

However, the toner of opposite or positive polarity existing on the roller 17 is electrostatically transferred to the drum 1, but not to the roller 14. This part of the toner deposits on the area of the drum 1 corresponding to the area of the roller 17 from which the toner has been collected.

In light of the above, for a preselected period of time B' (see FIG. 4) in which the area of the drum 1 corresponding to the above area of the roller 17 will move away from the position R, FIG. 2, the same bias as the bias for developing a latent image formed on the drum 1 is applied to the image transfer unit 5. Specifically, assume that the toner transferred from the roller 14 to the roller 17 at the position P reaches the position R in a period of time C. Then, on the elapse of the period of time C after the bias VbA has been switched to GND for toner collection, the bias applied to the image transfer roller 5 is switched to the usual bias and held thereat for the period of time B'. In this condition, because the bias of the image transfer roller 5 is of the same polarity as the charge of the drum 1, the toner of positive charge is prevented from being transferred from the drum 1 to the roller 5. The toner of positive charge moved away from the roller 5 is collected by the cleaning unit 8.

If the bias for image transfer is applied to the image transfer roller 5 when the sheet 10 is absent at the position R, it is apt to adversely influence the drum 1. It is therefore preferable that the periods of time B and B' be equal to each other in order to minimize the duration of the image transfer bias when the sheet 10 is absent at the position R. However, the period of time B' must be at least slightly longer than the period of time B.

With the above configuration, it is possible to cause the developing roller 14 to collect the toner left on the intermediate roller 17 without joining in the development. This obviates wasteful toner consumption and frees the sheet 10 from background contamination. Further, because the biases are varied in the event of collection of the toner from the roller 17 by the roller 14, the toner of opposite or positive polarity transferred from the roller 17 to the drum 1, as well as metallic soap, is prevented from depositing on the image transfer roller 5. As a result, the sheet 10 is protected from background contamination.

In the basic construction shown and described, the second toner conveying means may be implemented as a belt, if desired. While the bias VbA assigned to the developing roller 14 is switched to GND in the event of toner collection, it may alternatively be switched to, e.g., −100 V. The crux is that the direction of the electric field between the rollers 14 and 17 during the toner collection be different from the direction during the development. In addition, while the biases VbA and Vb are both switched over in the basic construction, only one of them may be switched over.

Generally, because an electrophotographic recording apparatus transfers a toner image derived from a latent image to a sheet, it may be considered that the latent image area is contained in a sheet area. Assuming that the latent image area is equal to the sheet area, the area of the drum 1 other than the latent image area corresponds to, e.g., the interval between consecutive sheets, the time before the start of printing, or the time after the end of printing.

In a preferred embodiment of the present invention, the operation of the switch 20 and the operation for switching the image transfer bias are controlled, as will be described with reference to FIG. 4. The switch 20 may be triggered by the output of the sheet position sensor 13 representative of the leading edge or the trailing edge of the sheet 10. For example, when the output of the sensor 13 representative of the leading edge is used as a trigger, the time for switching the bias VbA is calculated on the basis of the sensor output and the length of the sheet 10. When the output of the sensor 13 representative of the trailing edge is used as a trigger, the above time is calculated beforehand on the basis of the distance between the sensor 13 and the image transfer position. On the elapse of the calculated time after the sensor 13 has sensed the leading edge or the trailing edge of the sheet 10, the MPU 22 causes the switch 20 to switch the bias VbA. If desired, the trigger signal may be implemented by a signal representative of the start of an optical writing operation. Further, a timer may be caused to start counting the time in response to a plotter start trigger signal.

Figure 4:
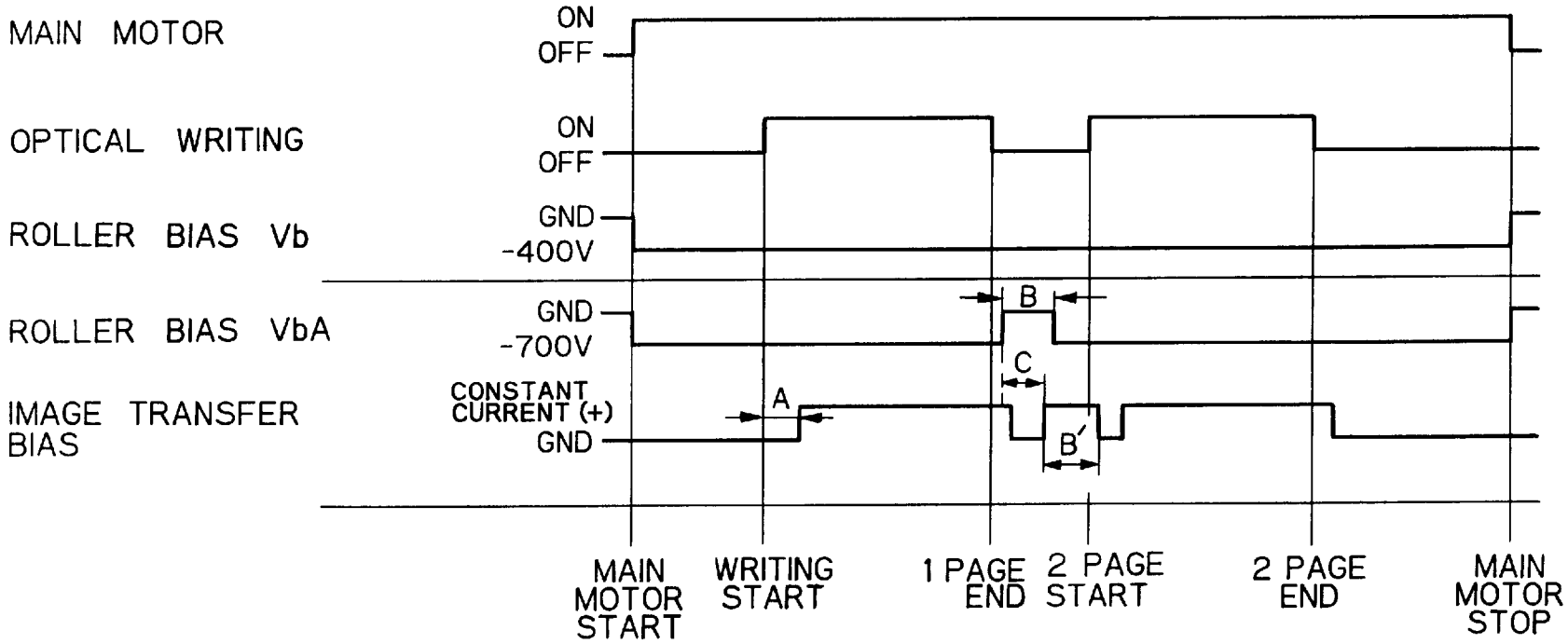
FIG. 4 is a timing chart demonstrating a specific operation of a preferred embodiment of the present invention.

As shown in FIG. 4, assume that a plurality of sheets 10 are conveyed one after another. Then, while the sheet area of the drum 1 corresponding to the preceding sheet 10 is in development, the bias VbA of −700 V is applied to the developing roller 14. In this condition, the toner is transferred from the developing roller 14 to the intermediate roller 17.

During the interval between the end of development of the above sheet area of the drum 1 and the beginning of development of the sheet area corresponding to the next or following sheet 10, i.e., during the development of the area other than the sheet areas, the switch 20 switches the bias VbA from −700 V to GND (0 V). At this instant, the bias of −400 V is continuously applied to the intermediate roller 17. Therefore, during the course of development of the area other than the sheet areas, the surface potential of the roller 17 remains lower than that of the roller 14. Consequently, the toner of negative charge is transferred from the roller 17 to the roller 14. In addition, because the rollers 14 and 17 move in opposite directions to each other at the position P, the toner on the roller 17 is removed by a mechanical force and transferred to the roller 14, as stated earlier.

When the next sheet area of the drum 1 is to be developed or after the sheet area corresponding to the last sheet 10 has been developed, the bias VbA is switched from −700 V to GND. As a result, the toner on the roller 17 is collected by the roller 14. Subsequently, the bias VbA is again switched from GND to −700 V to cause the toner to form a layer on the roller 17. After the resulting toner layer has been brought to the nip Q between the roller 17 and the drum 1, the drum 1 is caused to stop rotating.

By the above control, during the development of the area other other than the sheet areas, the toner is transferred from the roller 17 to the roller 14, but not from the roller 14 to the roller 17, because the surface potential of the roller 17 is lower than that of the roller 14. In addition, because the rollers 14 and 17 move in opposite directions to each other at the position P, the toner on the roller 17 is removed by a mechanical force and transferred to the roller 14.

However, the toner of opposite or positive polarity existing on the intermediate roller 17 is electrostatically transferred to the drum 1, but not to the developing roller 14. This part of the toner deposits on the area of the drum 1 corresponding to the area of the roller 17 from which the toner has been collected.

This embodiment solves the above problem by the following procedure. As shown in FIGS. 2 and 4, after the initial optical writing has begun at the position S, the leading edge of the resulting latent image arrives at the position R where the drum 1 and image transfer unit 5 contact each other. Then, the bias for image transfer is applied to the image transfer roller 5. When the trailing edge of the latent image arrives at the position R, the bias for image transfer is returned to GND. Subsequently, when the point of the drum 1 corresponding to the point of the roller 17 where the toner has begun to be collected arrives at the position R, i.e., on the elapse of the period of time C after the switching of the bias VbA to GND, the bias is applied to the roller 5. When the point of the drum 1 corresponding to the point of the roller 17 where the collection of the toner has ended arrives at the position R, i.e., on the elapse of the period of time B after the switching of the usual bias, the bias for the roller 5 is restored to GND. Thereafter, the bias is applied to the roller 5 when the leading edge of the next latent image arrives at the position R.

The above control equalizes the charge deposited on the drum 1 and the bias applied to the image transfer roller 5 as to polarity. Therefore, the toner of opposite polarity is left on the drum 1 without being transferred to the roller 5 and then collected by the cleaning unit 8.

Figure 5:
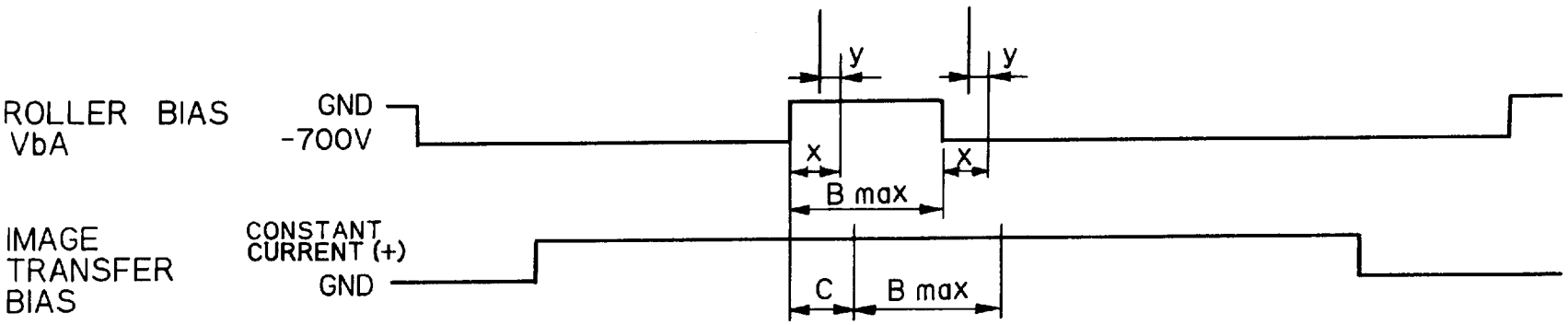
FIG. 5 is a timing chart associated with FIG. 4.

In this case, as shown in FIG. 5, the maximum duration of the GND level of the bias VbA is Bmax, i.e., the interval between the end of the optical writing of the first image and the beginning of the optical writing of the second image.

In FIG. 5, x is a period of time necessary for the toner deposited on the intermediate roller 17 at the position P to reach the nip Q between the roller 17 and the drum 1, while y is a period of time necessary for the latent image formed on the drum 1 at the position S to reach the nip Q. The time for applying the bias VbA to the developing roller 14 is determined by the periods of time x and y which are expressed as:

$$x=q/v_{mid}$$

$$y=r/v$$

where q is the length of the arc PQ, $V_{mid}$ is the linear velocity of the intermediate roller 17, r is the length of the arc SQ, and v is the linear velocity of the drum 1.

Figure 8:
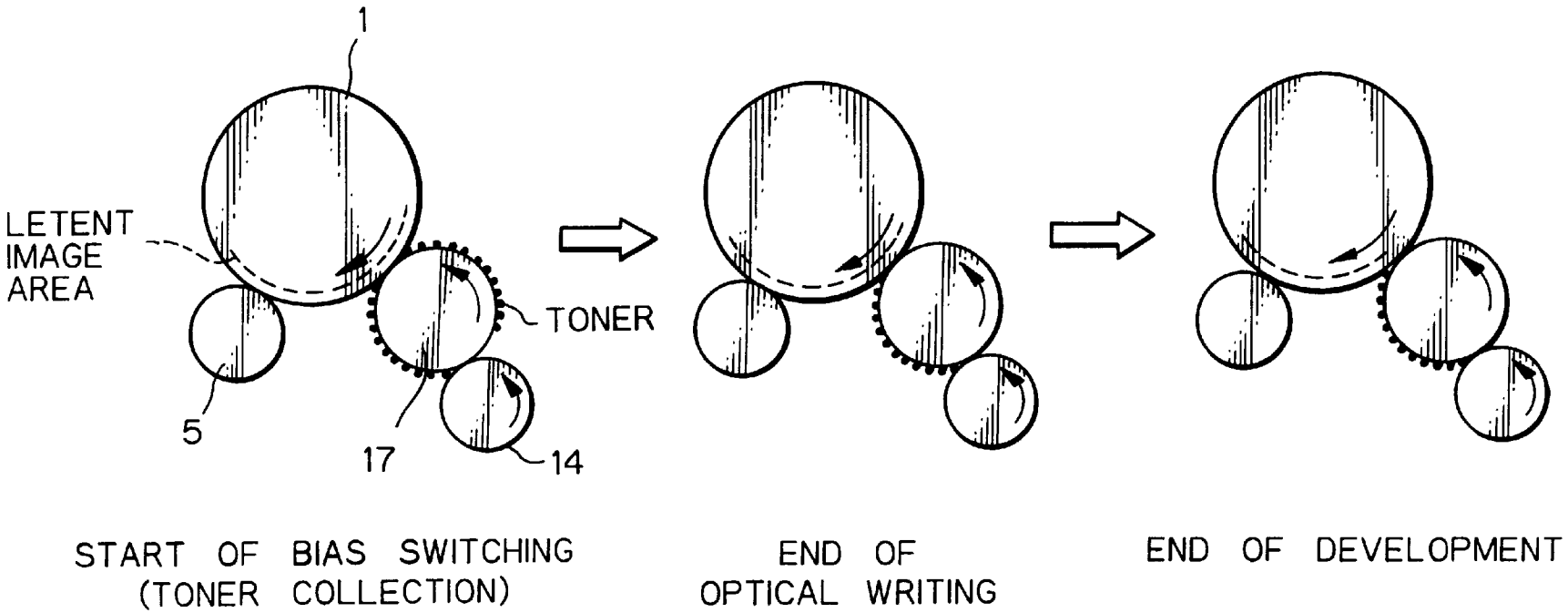
FIG. 8 shows a procedure for collecting toner.

Specifically, as shown in FIG. 8, if the bias VbA starts being switched x second before the trailing edge of the latent image formed on the drum 1 reaches the nip Q between the roller 17 and the drum 1, then the toner collection area of the roller 17 arrives at the nip Q just after the trailing edge of the latent image has moved away from the nip Q.

Figure 9:
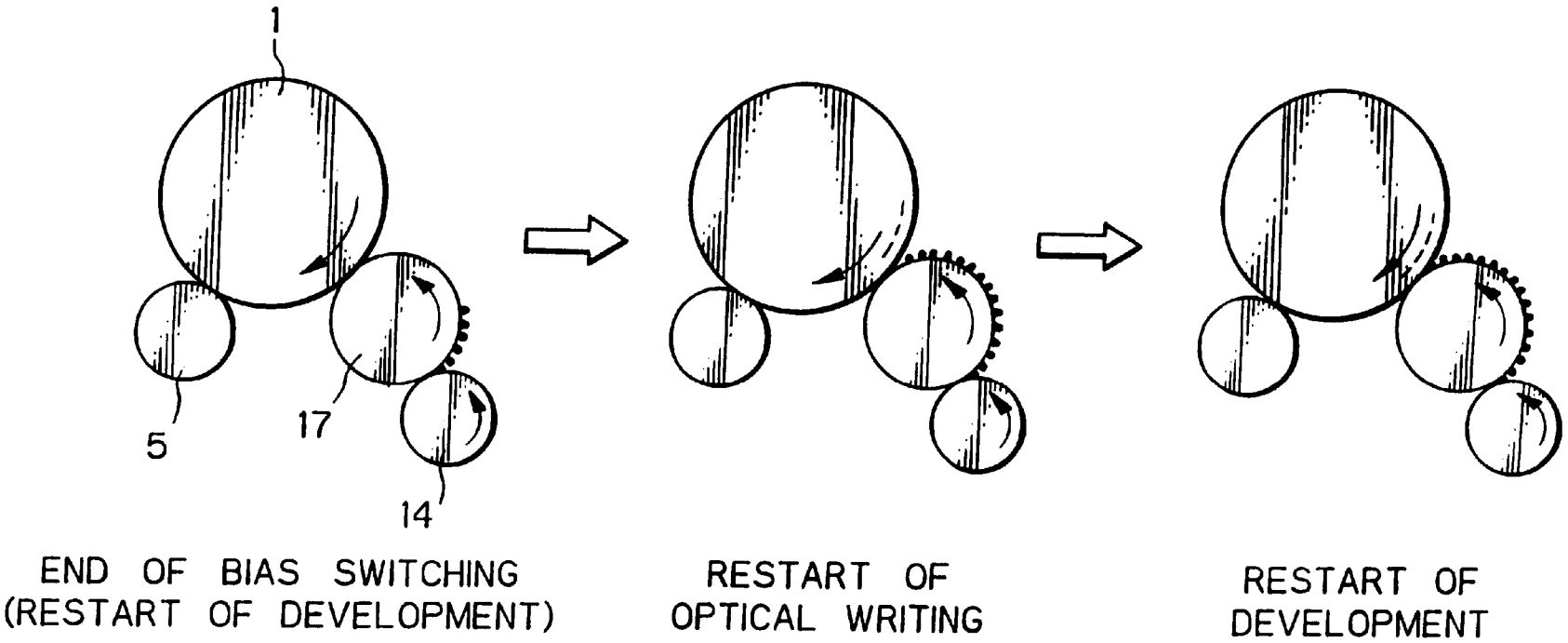
FIG. 9 shows how development is resumed.

This is also true with the end of the switching of the bias VbA. As shown in FIG. 9, if the switching of the bias VbA ends (i.e. if the toner deposition on the roller 17 begins) x second before the leading edge of the latent image formed on the drum 1 reaches the nip Q, the area of the roller 17 from which the toner has been collected arrives at the nip Q just before the leading edge of the latent image moves away from the nip Q.

As stated above, in the illustrative embodiment, a toner layer is left between the drum 1 and the intermediate roller 17 after a printing operation. The toner layer prevents the drum 1 and roller 17 from adhering to each other when the apparatus is left unused over a long period of time, thereby obviating defective images ascribable to the adhesion. Because the toner existing on the roller 17 is collected during the course of development of the area between consecutive sheet areas, there are eliminated background contamination and wasteful toner consumption. Further, the toner charged to the opposite polarity is not transferred to the image transfer roller 5, but simply left on the drum 1. This part of the toner is collected by the cleaning unit 8 and prevented from smearing the rear of the sheet 10.

Another embodiment of the present invention will be described with reference to FIG. 6 and also pertains to the control over the biases. At the time when the main motor 21 starts rotating, it is preferable that the toner be present on the intermediate roller 17 in order to reduce the required torque. For this purpose, the biases VbA and Vb assigned to the rollers 14 and 17, respectively, begin to be switched just before the main motor 21 starts rotating. The rotation of the main motor 21 becomes stable in a period of time E after the start of rotation. When the rotation of the main motor 21 becomes stable, the bias VbA is switched to GND and is held at GND up to the start of development of the first sheet area of the drum 1. This period of time is labeled D in FIG. 6. Further, the bias for image transfer is applied to the image transfer roller 5 on the elapse of the period of time C (see FIG. 4) after the switching of the bias VbA to GND.

Figure 6:
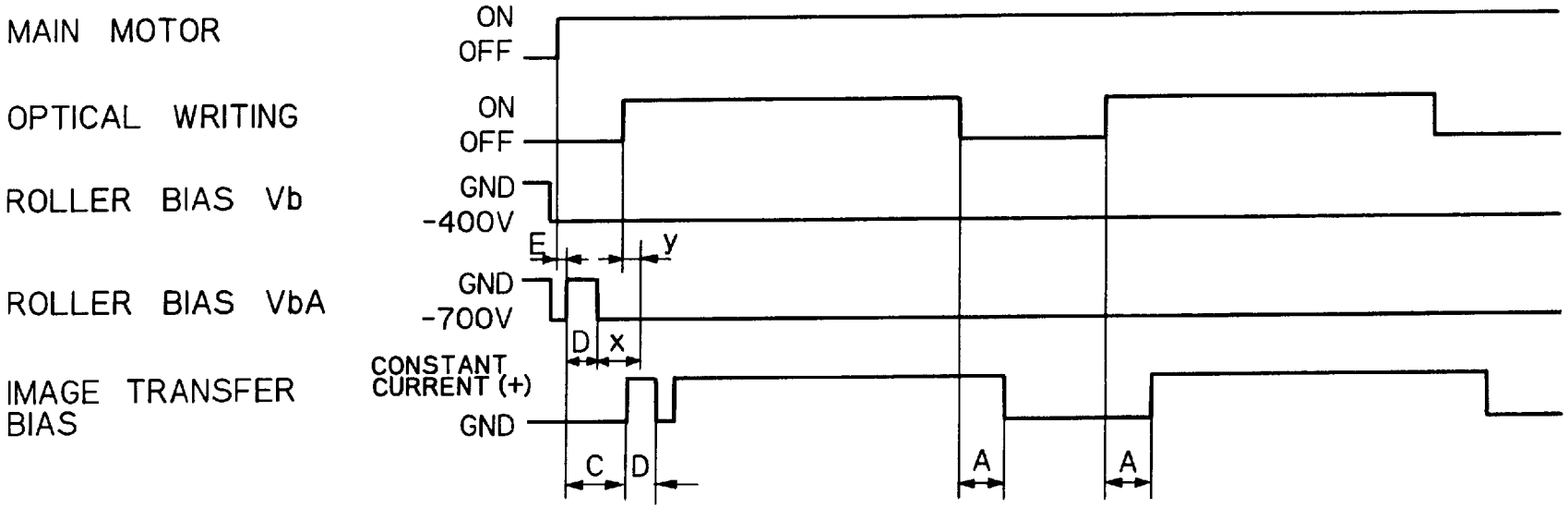
FIG. 6 is a timing chart representative of a specific operation of another embodiment of the present invention.

As also shown in FIG. 6, the bias for image transfer is applied to the image transfer roller 5 on the elapse of the period of time C after the switching of the bias VbA. On the elapse of the period of time D, the bias VbA is switched to GND. Subsequently, on the elapse of the period of time C after the start of the optical writing, the bias for image transfer is applied to the unit 5.

The above control successfully reduces the torque at the time when the main motor 21 starts rotating. However, just after the start of rotation of the motor 21, the toner charged to the regular or negative polarity, but short of charge, is deposited on the roller 17 during the period of time E because the charge of the drum 1 and that of the toner are often insufficient. In the embodiment, just after the rotation of the motor 21 has been stabilized, but before the development of the latent image, the toner collection from the roller 17 and the control over the image transfer bias are executed. As a result, the toner existing on the roller 17 is collected and prevented from depositing on the defectively charged portion of the drum 1. In addition, the toner of opposite polarity and metallic soap remaining on the roller 17 are transferred to the drum 1 and then collected by the cleaning unit 8. This obviates the wasteful consumption of the toner adequate for image formation and allows the cleaning unit 8 to collect the toner of opposite polarity not adequate for image formation. Therefore, the background of the sheet 10 is protected from contamination.

A reference will be made to FIG. 7 for describing a further embodiment of the present invention. This embodiment, like the embodiment described first, switches the bias VbA assigned to the developing roller 14 from −700 V to GND for a preselected period of time during the course of development of the area other than the sheet area just before the stop of rotation of the drum 1. In addition, this embodiment applies, while the area of the drum corresponding to the toner collection area of the intermediate roller 17 is passing through between the drum 1 and the image transfer unit 5, the same bias as the bias for the image transfer from the drum 1 to the image transfer roller 5.

Figure 7:
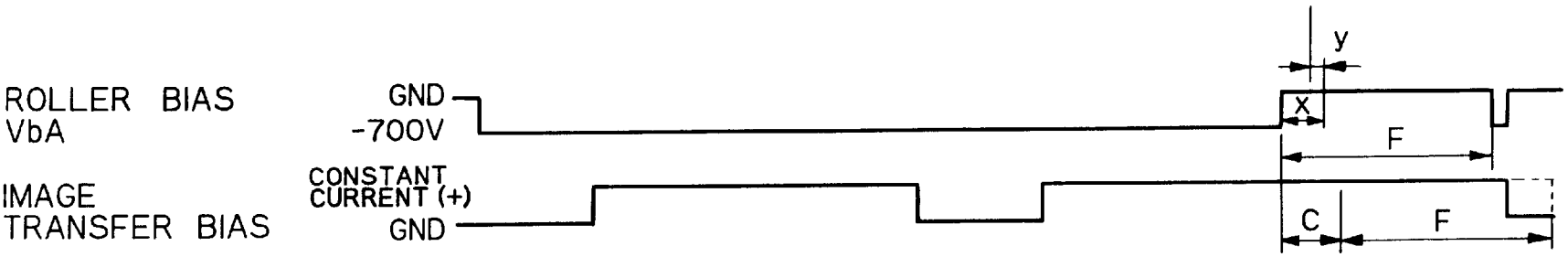
FIG. 7 is a timing chart representative of a specific operation of a further embodiment of the present invention.

Specifically, as shown in FIG. 7, the bias VbA is switched only for a preselected period of time F during the interval between the end of the sheet area of the drum 1 and the stop of rotation of the drum 1 and rollers. In addition, as shown in FIG. 6, the bias for image transfer is applied to the roller 5 on the elapse of the period of time C after the switching of the bias VbA from −700 V to GND. If the bias has already been applied to the unit 5, it is maintained.

The earliest possible time for switching the bias VbA from −700 V to GND should be x second before the trailing edge of the latent image formed on the drum 1 arrives at the nip Q between the intermediate roller 17 and the drum 1. However, as shown in FIG. 7, if the time for applying the image transfer bias is coincident with the time for switching the bias VbA, then the image transfer bias will be continuously applied even after the stop of rotation of the motor 21. In such a case, the image transfer bias should only be interrupted at the same time as the biases Vb and VbA.

By the above control, it is possible to obviate wasteful toner consumption during the interval between the end of development and the stop of operation of the apparatus. Moreover, because the toner charged to the opposite polarity is held in contact with the surface of the drum 1 brought to a stop, the load to act on the cleaning unit 8 at the beginning of the next rotation of the drum 1 is reduced.

In summary, it will be seen that the present invention provides an electrophotographic recording apparatus having various unprecedented advantages, as enumerated below.

(1) Toner left on second toner conveying means without joining in the development of a latent image is collected by first toner conveying means. This obviates the wasteful consumption of toner and the wasteful consumption of toner adequate for image formation.

(2) The toner charged to the opposite polarity and left on the second toner conveying means without being collected is transferred to an image carrier. However, while the toner of opposite charge is conveyed via a position where the image carrier contacts image transferring means, a usual bias for image transfer is applied to the image transferring means. As a result, the toner of opposite polarity is prevented from depositing on the image transferring means, so that the rear of a sheet is free from contamination. In addition, the toner of opposite polarity and not adequate for image formation is collected from the drum by a cleaning unit.

(3) A particular period of time is set for the area of the image carrier corresponding to the area of the second toner conveying means from which the toner has been collected to move away from the image transferring means. Hence, an image transfer bias can be surely switched over. This prevents the image transfer bias from being applied for more than a necessary period of time in the event of the toner collection from the second toner conveying means.

(4) The toner short of charge is prevented from depositing on the image carrier.

(5) The application of the bias to the image transferring means can be surely ended.

Various modifications will become possible for those skilled in the art after receiving the teachings of the present disclosure without departing from the scope thereof.

What is claimed is:

1. An electrophotographic recording apparatus comprising:

an image carrier for electrostatically forming a latent image thereon;

a developing unit comprising first toner conveying means for conveying a toner deposited thereon, and second toner conveying means for conveying the toner transferred thereto from said first toner conveying means and depositing said toner on the latent image thereby to produce a corresponding toner image;

image transferring means for transferring the toner image to a sheet when said image transferring means is at a first bias potential, but not at a second bias potential;

control means for switching, during toner deposition to an area of said image carrier other than a latent image area, at least one of a bias assigned to said first toner conveying means and a bias assigned to said second toner conveying means thereby to form an electric field different in direction from an electric field assigned to a formation of the toner image between said first toner conveying means and said second toner conveying means, whereby the toner existing on said second toner conveying means is collected by said first toner conveying means; and a bias controller configured to change a bias condition of said image transfer means from said first bias potential to said second bias potential after transferring the toner image and changing back to said first bias potential after said control means switches said at least one bias.

2. An apparatus as claimed in claim 1, wherein said area other than said latent image area corresponds to an interval between consecutive sheets.

3. An apparatus as claimed in claim 1, wherein said bias controller comprises bias control means for changing back to the first bias potential only when an area of said image carrier that previously contacted said second toner conveying means from which the toner has been collected contacts said image transferring means.

4. An apparatus as claimed in claim 3, wherein said bias control means changes back to the first bias potential on the elapse of a time interval between a first time and a second time, said first time being when the control means switches the bias, said second time being when a predetermined point on said image carrier is in contact said image transferring means, said predetermined point having previously contacted said second toner conveying means at a predetermined portion thereof, said predetermined portion of said second conveying means having previously been in contact with said first toner conveying means at said first time.

5. An apparatus as claimed in claim 3, wherein a duration of said first bias potential applied to said image transferring means is equal to or longer than a duration of a collection of the toner of said second toner conveying means by said first toner conveying means.

6. An apparatus as claimed in claim 1, wherein said area other than said latent image area corresponds to a sheet area preceding a formation of the toner image.

7. An apparatus as claimed in claim 6, wherein said bias controller comprises bias control means for applying to said image transferring means the first bias potential when an area of said image carrier that previously contacted said second toner conveying means from which the toner has been collected contacts said image transferring means.

8. An apparatus as claimed in claim 7, wherein said bias control means applies said first bias potential on the elapse of a time interval between a first time and a second time, said first time being when the control means switches the bias, said second time being when a predetermined point on said image carrier is in contact said image transferring means, said predetermined point having previously contacted said second toner conveying means at a predetermined portion thereof, said predetermined portion of said second conveying means having previously been in contact with said first toner conveying means at said first time.

9. An apparatus as claimed in claim 7, wherein a duration of said first bias potential applied to said image transferring means is equal to or longer than a duration of a collection of the toner of said second toner conveying means by said first toner conveying means.

10. An apparatus as claimed in claim 6, wherein said bias is switched after said image carrier has reached a stable rotation after a start of rotation.

11. An apparatus as claimed in claim 1, wherein said area other than said latent image area corresponds to an area other than a sheet area preceding a stop of rotation of said image carrier.

12. An apparatus as claimed in claim 1, wherein said bias controller comprises bias control means for applying to said image transferring means the first bias potential when an area of said image carrier that previously contacted said second toner conveying means from which the toner has been collected contacts said image transferring means, said third bias potential being the same as said first bias potential.

13. An apparatus as claimed in claim 12, wherein a duration of a collection of the toner of said second toner conveying means by said first toner conveying means and a duration of an application of said first bias potential to said image transferring means are equal to each other, and wherein when an application of said first bias potential to said image transferring means is under way on a stop of said image carrier, said first bias potential and said bias for collecting the toner of said second conveying means are stopped.

14. The apparatus of claim 1, wherein said toner conveyed by said first toner conveying means is of a single-component type.

15. The electrophotographic recording apparatus of claim 1, wherein said first bias potential of said image transferring means applied as a constant current.

16. An electrophotographic recording apparatus comprising:

an image carrier for electrostatically forming a latent image thereon;

a developing unit comprising first toner conveying means for conveying toner deposited thereon, and second toner conveying means for conveying the toner transferred thereto from said first toner conveying means and depositing said toner on the latent image to thereby produce a corresponding toner image, said first and second toner conveying means contacting each other and each rotating counterclockwise at its contact position;

image transferring means for transferring the toner image to a sheet; and control means for switching, during toner deposition to an area of said image carrier other than a latent image area, at least one of a bias assigned to said first toner conveying means and a bias assigned to said second toner conveying means to thereby form an electric field different in direction from an electric field assigned to a formation of the toner image between said first toner conveying means and said second toner conveying means, whereby the toner existing on said second toner conveying means is collected by said first toner conveying means;

wherein a maximum duration of switching of said at least one of said bias assigned to said first and second toner conveying means is the interval between an end of an optical writing of a first image and a beginning of an optical writing of a second image.

17. An electrophotographic recording apparatus comprising:

an image carrier for electrostatically forming a latent image thereon;

a developing unit comprising first toner conveying means for conveying toner deposited thereon, and second toner conveying means contacting said image carrier and said first toner conveying means at first and second positions, respectively, for conveying the toner transferred thereto from said first toner conveying means and depositing said toner on the latent image to thereby produce a corresponding toner image;

image transferring means for transferring the toner image to a sheet; and control means for switching, during toner deposition to an area of said image carrier other than a latent image area, a bias assigned to said first toner conveying means to thereby form an electric field different in direction from an electric field assigned to a formation of the toner image between said first toner conveying means and said second toner conveying means, whereby the toner existing on said second toner conveying means is collected by said first toner conveying means;

wherein said switching of said bias assigned to said first toner conveying means starts X second before the trailing edge of the latent image formed on said image carrier reaches said first position, and X=q/Vmid, where q is the length of a arc between said first and second positions and Vmid is a linear velocity of said second toner conveying means.

18. An electrophotographic recording apparatus comprising:

an image carrier for electrostatically forming a latent image thereon;

a developing unit comprising first toner conveying means for conveying toner deposited thereon, and second toner conveying means contacting said image carrier and said first toner conveying means at first and second positions, respectively, for conveying the toner transferred thereto from said first toner conveying means and depositing said toner on the latent image to thereby produce a corresponding toner image;

image transferring means for transferring the toner image to a sheet; and control means for switching, during toner deposition to an area of said image carrier other than a latent image area, a bias assigned to said first toner conveying means to thereby form an electric field different in direction from an electric field assigned to a formation of the toner image between said first toner conveying means and said second toner conveying means, whereby the toner existing on said second toner conveying means is collected by said first toner conveying means;

wherein said switching of said bias assigned to said first toner conveying means ends X second before the leading edge of the latent image formed on said image carrier reaches said first position, and X=q/Vmid, where q is the length of an arc between said first and second positions and Vmid is a linear velocity of said second toner conveying means.

* * * * *